US006159040A

United States Patent [19]

Chang et al.

[11] Patent Number: 6,159,040

[45] Date of Patent: Dec. 12, 2000

[54] INSULATOR FOR RETAINING CONTACTS OF CONNECTOR ASSEMBLY AND METHOD FOR MAKING THE SAME

[75] Inventors: Yao-Hao Chang, Tu-Chen; Tien-Chien Wang, Pan-Chiao, both of Taiwan

[73] Assignee: Hon Hai Precision Ind. Co., Ltd., Taipei Hsien, Taiwan

[21] Appl. No.: 09/394,856

[22] Filed: Sep. 13, 1999

[30] Foreign Application Priority Data

Dec. 18, 1998 [TW] Taiwan ..... 87121201

[51] Int. Cl.[7] ..... H01R 13/518

[52] U.S. Cl. ..... 439/541.5; 439/701

[58] Field of Search ..... 439/541.5, 79, 439/736, 701

[56] References Cited

U.S. PATENT DOCUMENTS 4,469,387 9/1984 McHugh .
5,336,109 8/1994 Hillbish et al. ..... 439/541.5
5,511,984 4/1996 Olson et al. ..... 439/701
5,591,036 1/1997 Doi et al. ..... 439/79
5,785,537 7/1998 Donahue et al. ..... 439/701
5,975,917 11/1999 Wang et al. ..... 439/79

*Primary Examiner*—Gary F. Paumen
*Attorney, Agent, or Firm*—Wei Te Chung

[57] ABSTRACT

A stacked electrical connector comprises a bracket, upper and lower electrical connectors attached to the bracket, a number of contacts received in the corresponding connectors, and upper and lower insulators respectively insert molded around a second row and a fourth row of contacts received in the upper connector. The bracket comprises a mating board with a pair of receiving slots disposed therein for receiving the connectors. The contacts of the upper connector are retained by the insulators thereby preventing an upward movement of strain portions of the contacts away from a circuit board during insertion of tail portions of the contacts thereinto. A method for retaining four rows of contacts in an upper connector of a stacked electrical connector assembly is also provided by the present invention.

10 Claims, 7 Drawing Sheets

INSULATOR FOR RETAINING CONTACTS OF CONNECTOR ASSEMBLY AND METHOD FOR MAKING THE SAME

BACKGROUND OF THE INVENTION

The present invention relates to a stacked electrical connector assembly, and more particularly to an assembly with an insulator for retaining contacts of an upper connector thereof in position and a method for making the same.

Description of Prior Art

In a conventional stacked electrical connector assembly, a spacer is used to align tail portions of contacts downwardly extending from a housing of the connector with receiving holes of a circuit board thereby facilitating easy mounting of the connector to the circuit board. U.S. Pat. Nos. 4,469,387 and 5,591,036 disclose such an arrangement.

FIG. 8 depicts a conventional stacked electrical connector assembly having a spacer 9 for retaining tail portions 81, 81' of contacts 8, 8' in position. The stacked electrical connector assembly comprises an upper connector 7 and a lower connector 7' joined together by an L-shaped plate 6. The contacts 8, 8' extend from insulative housings 71, 71' of the upper and lower connectors 7, 7', and are bent at a right angle for being inserted into corresponding receiving holes arranged in a circuit board (not shown).

The contacts 8 of the upper connector 7 are much longer than the contacts 8' of the lower connector 7', especially the downwardly extending tail portions 81. Thus, alignment between the contacts 8 and the circuit board is difficult to accomplish. To solve such a problem, the spacer 9 is used to retain the tail portions 81 of the contacts 8 in position thereby facilitating correct insertion of the tail portions 81 into the corresponding receiving holes of the circuit board. However, since the tail portions 81 of the contacts 8 are L-shaped, vertical movement of the tail portions 81 relative to the spacer 9 is not easy to overcome. When inserting the contacts 8 into the corresponding receiving holes of the circuit board, the tail portions 81 of the contacts 8 may become upwardly displaced and deflected due to frictional forces existing therebetween. In such a case, not only are the contacts 8 deformed or damaged, but also the positional relationship between the contacts 8 is changed whereby two adjacent contacts 8 are connected resulting in a short circuit and adversely affecting signal transmission.

SUMMARY OF THE INVENTION

Accordingly, a main object of the present invention is to provide a stacked electrical connector assembly comprising upper and lower connectors attached together, wherein the upper connector has an insulator for preventing an upward movement of the contacts away from a circuit board during insertion of the contacts thereinto thereby preventing the contacts from deflecting and deforming so as to obviate the formation of a short circuit between two adjacent contacts.

Another object of the present invention is to provide an electrical connector having an insulator for enhancing the ability of contacts to resist external forces acting thereon.

A further object of the present invention is to provide a method for retaining a plurality of rows of contacts in an upper connector of a stacked connector assembly in position thereby preventing an upward movement of the contacts away from a circuit board during insertion of the contacts thereinto.

In order to achieve the objects set forth, a stacked electrical connector assembly mounted to a circuit board for interconnecting mating connectors with the circuit board comprises a bracket, upper and lower connectors attached to the bracket, a plurality of contacts received in the upper and lower connectors, and a pair of insulators insert molded around right-angled bent portions of a second row and a fourth row of the upper connectors to respectively define lower and upper contact modules. The bracket comprises a mating board with a plurality of receiving slots disposed therein corresponding to the connectors and a pair of opposite side walls perpendicularly extending from a rear surface of the mating board. Each connector comprises an insulative housing having a protrusion projecting therefrom and extending through the corresponding slot of the bracket. A plurality of contact-receiving passageways arranged in two rows is defined in the protrusion for receiving the corresponding contacts therein. The contacts of the upper connector are retained by the insulator thereby preventing an upward movement of right-angled bent portions of the contacts away from the circuit board during insertion of tail portions of the contacts into corresponding receiving holes of the circuit board.

A method comprising inserting steps and molding steps for retaining four rows of contacts in an upper connector of a stacked connector assembly is also provided by the present invention.

Other objects, advantages and novel features of the invention will become more apparent from the following detailed description when taken in conjunction with the accompanying drawings.

DETAILED DESCRIPTION OF THE INVENTION

Figure 1:
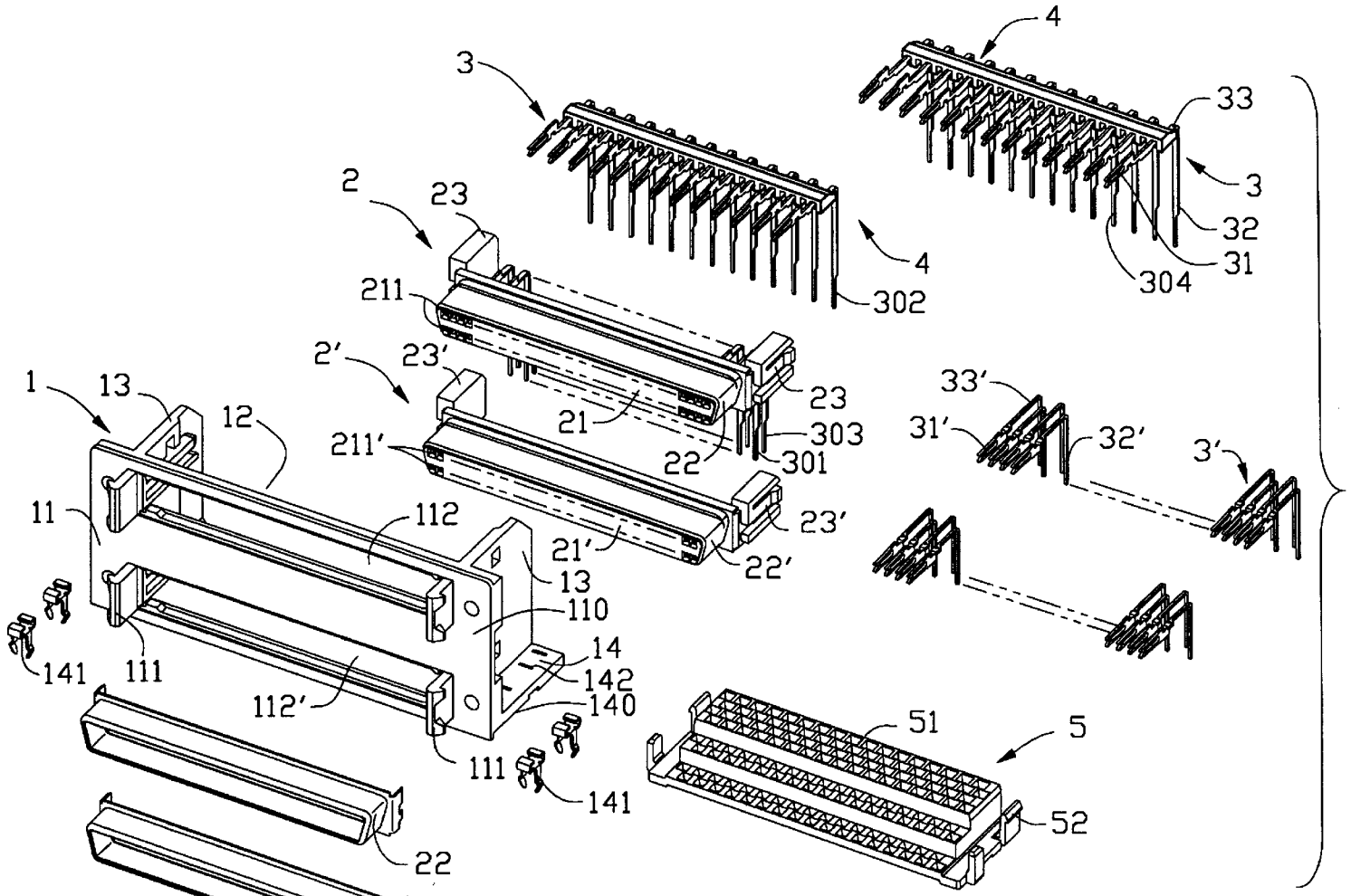
FIG. 1 is an exploded view of a stacked electrical connector assembly in accordance with the present invention.

For facilitating understanding, like components are designated by like reference numerals throughout the various drawing figures.

Referring to FIG. 1, a stacked electrical connector assembly in accordance with the present invention comprises a bracket 1, a pair of insulative housings 2, 2', a plurality of contacts 3, 3' respectively received in the housings 2, 2', upper and lower insulators 4 and a spacer 5. The housing 2, the contacts 3 and the insulators 4 constitute an upper electrical connector, and the housing 2' and the contacts 3' constitute a lower electrical connector.

The bracket 1 comprises a vertical mating board 11 secured to a circuit board (not shown), which will be described in detail later. The mating board 11 has a front surface 110 which serves as a common mating surface for the attached upper and lower connectors. A pair of receiving slots 112, 112' is disposed in the mating board 11 for extension of the respective upper and lower connectors therethrough. A pair of latching arms 111 forwardly extends from opposite ends of each slot 112, 112' for engaging with corresponding latching members of a mating connector (not shown). A pair of side walls 13 perpendicularly extends from the mating board 11 proximate the opposite ends of each slot 112, 112'. A receiving space 12 is defined between the side walls 13 and the mating board 11 for receiving the upper and lower connectors and the spacer 5 therein.

A base board 14 outwardly extends from a bottom portion of each side wall 13 and is integral with the mating board 11 to define a mounting surface 140 for mounting to the circuit board. A plurality of holes 142 is disposed in each base board 14 for mounting boardlocks 141 which is inserted into corresponding apertures of the circuit board thereby locking the bracket 1 to the circuit board. Alternatively, other engaging means, such as mounting posts, may also be employed to serve the same function.

Since the insulative housings 2, 2' of the upper and lower connectors are identical in configuration, only the housing 2 of the upper connector will be described in detail. It should be understood that although only one type of electrical connector is described, other types of electrical connectors may also be embodied.

The insulative housing 2 comprises a D-shaped protrusion 21 extending therefrom and a shield 22 enclosing the protrusion 21 for shielding the upper connector from EMI/RFI (Electromagnetic Interference/Radio Frequency Interference). A plurality of contactreceiving passageways 211 arranged in upper and lower rows is defined through the protrusion 21 and the housing 2. The protrusion 21 enclosed by the shield 22 extends through the corresponding slot 112 of the bracket 1 for mating with a complementary mating connector. The housing 2 further comprises a pair of arms 23 integrally extending away from the protrusion 21. Engaging means is formed on the arms 23 for engaging with corresponding engaging means on inner surfaces of the side walls 13 of the bracket 1 thereby retentively attaching the housing 2 to the bracket 1.

The contacts 3, 3' are arranged in four rows and are identical in configuration, but each contact 3 of the upper connector is much longer than the contact 3' of the lower connector. Each contact 3, 3' comprises a contact portion 31, 31' at a free end thereof, a tail portion 32, 32' at an opposite end and an intermediate right-angled bent portion 33, 33', respectively. The contact portions 31, 31' are received in the corresponding contact-receiving passageways 211, 211' of the housings 2, 2', for connecting with contacts of the corresponding mating connector. When the housings 2, 2' with the contacts 3, 3' received therein are engaged with the bracket 1, the tail portions 32, 32' extend beyond a bottom surface of the bracket 1 for insertion into corresponding receiving holes of the circuit board.

Since the contact 3 of the upper connector is much longer than the contact 3' of the lower connector, there is a tendency for the right-angled bent portions 33 of the contact 3 to upwardly move during insertion of the tail portions 32 of the contacts 3 into the corresponding receiving holes of the circuit board. Accordingly, the insulators 4 made from dielectric material such as plastic are provided for retaining the contacts 3 of the upper connector in position.

Figure 4:
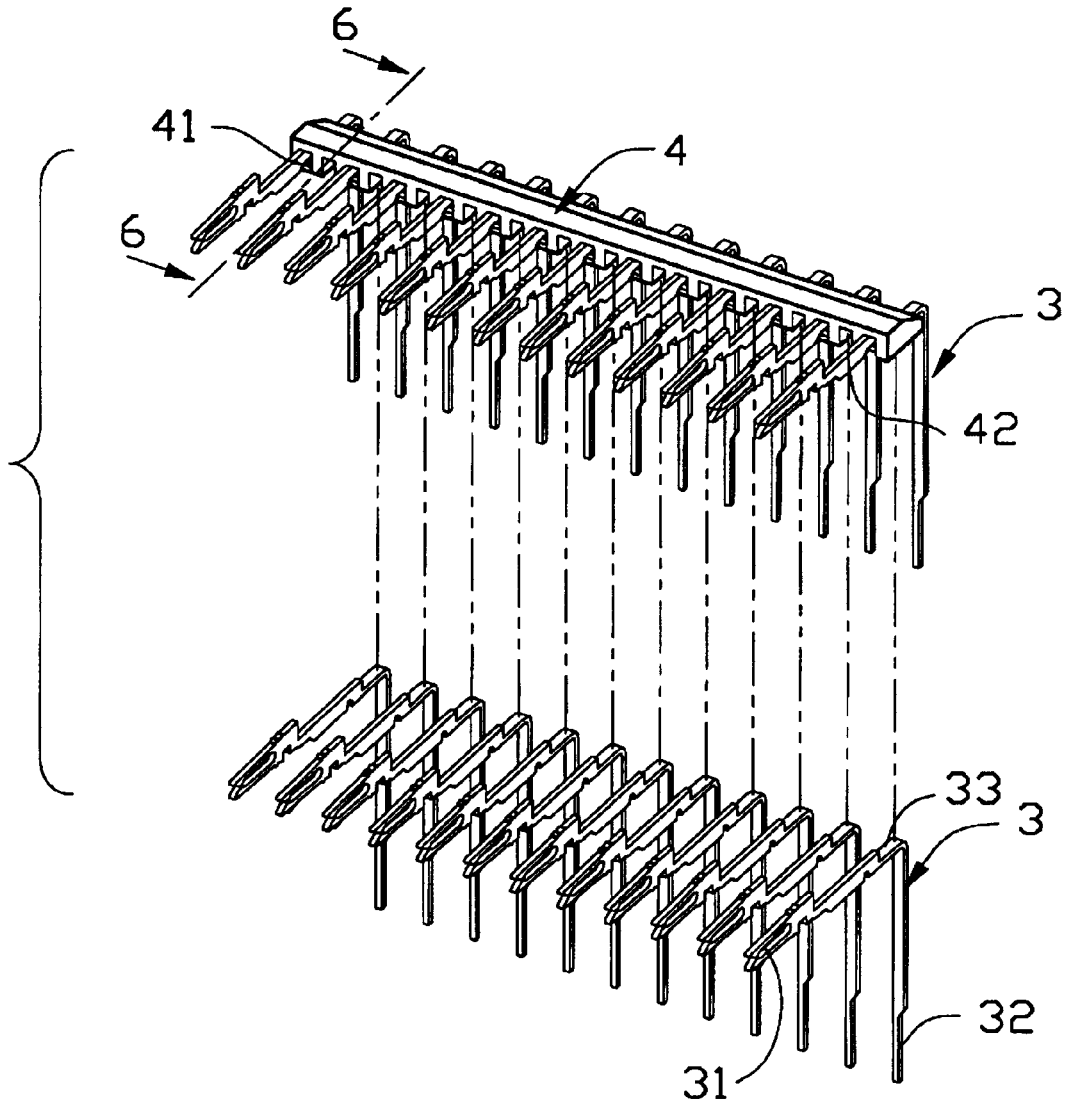
FIG. 4 is a schematic view of a contact module and a row of contacts of the upper connector.
Figure 5:
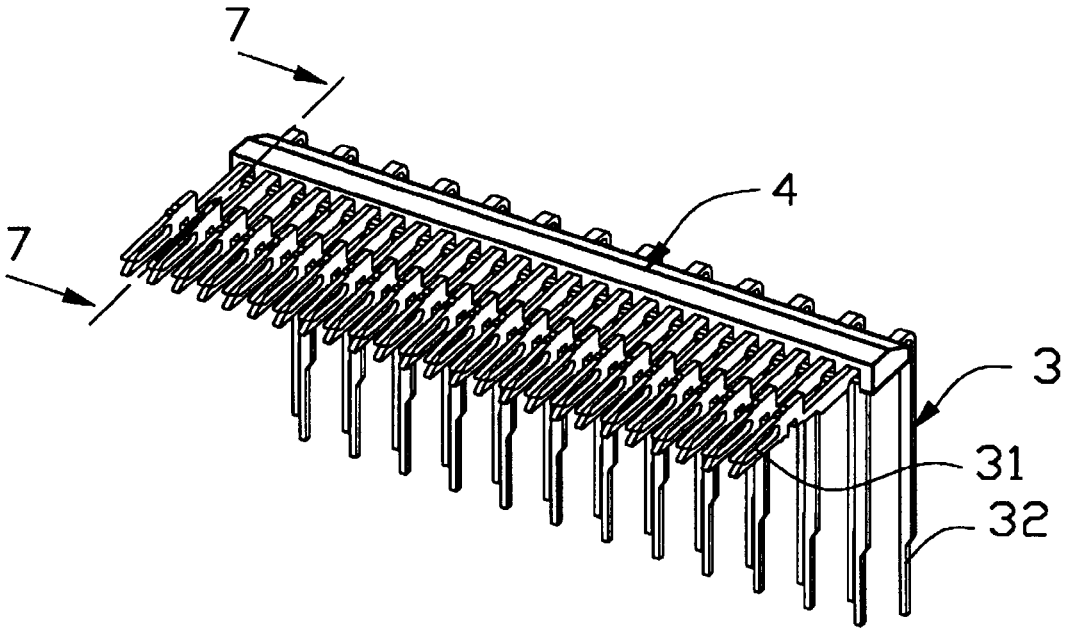
FIG. 5 is an assembled view of FIG. 4.
Figure 6:
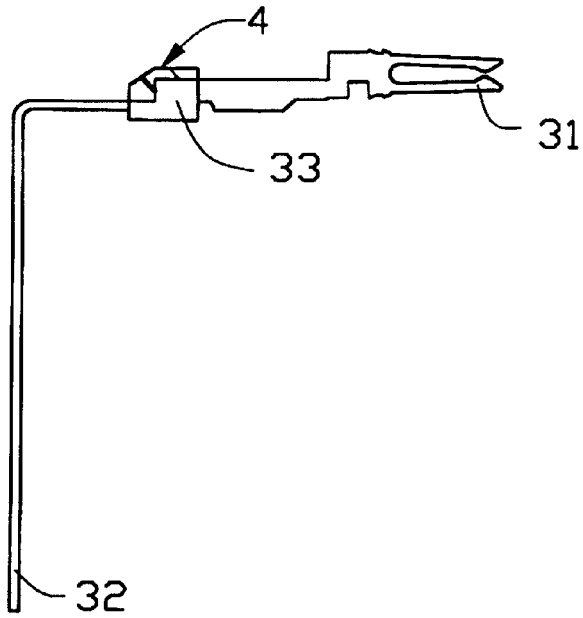
FIG. 6 is a cross-sectional view taken along line 6—6 of FIG. 4 showing a contact and an integrally molded insulator.
Figure 7:
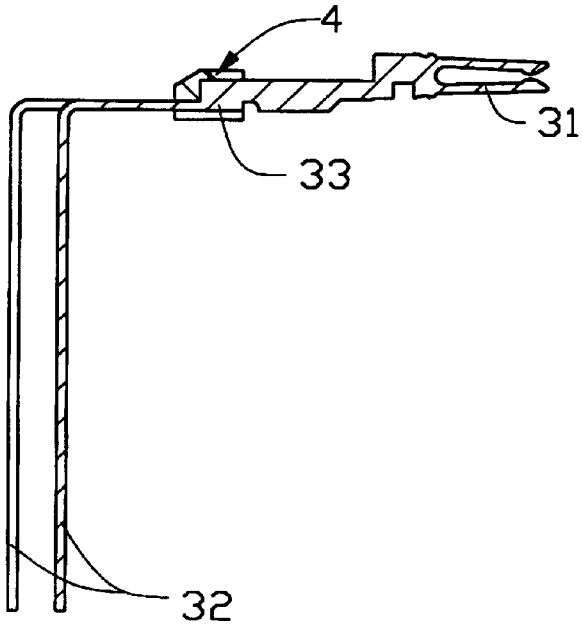
FIG. 7 is a cross-sectional view taken along line 7—7 of FIG. 5.
Figure 8:
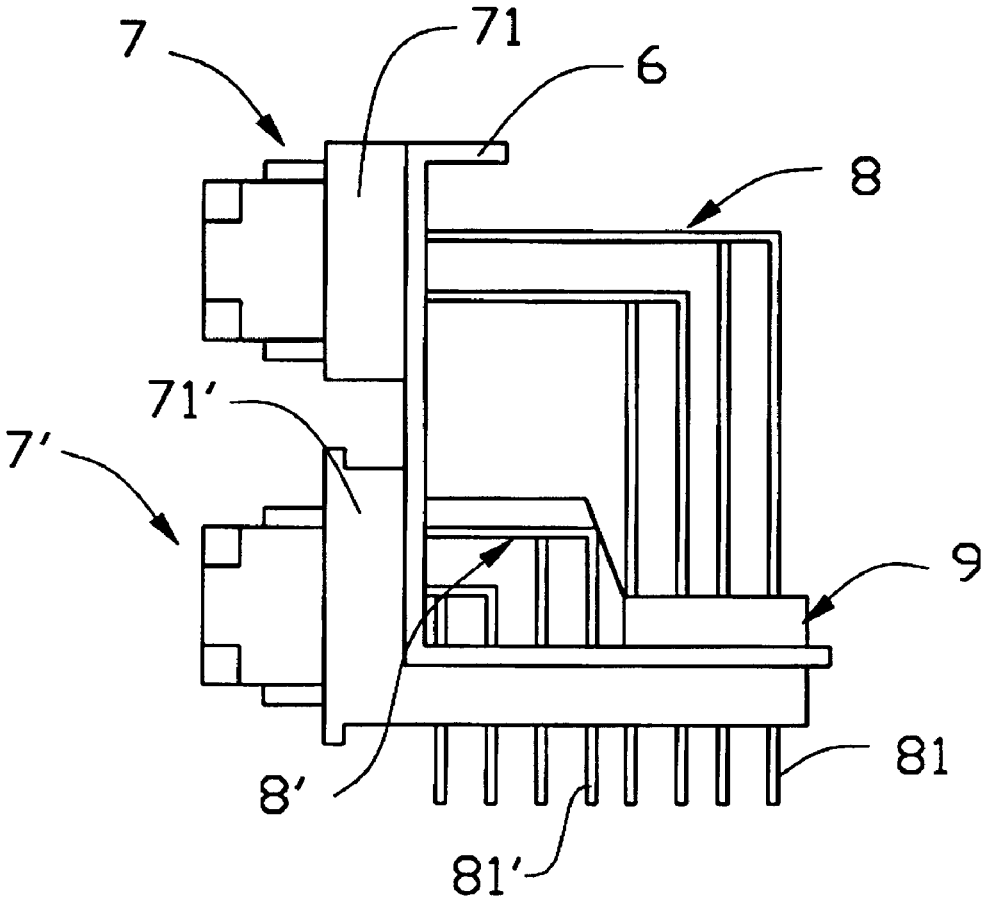
FIG. 8 (PRIOR ART)
FIG. 8 is a side view of a conventional stacked electrical connector assembly.

Also referring to FIG. 4, each of the upper and lower insulators 4 comprises a strip respectively insert molded around the fourth and the second rows of contacts 3 adjacent to the right-angled bent portions 33 thereof. Each of the lower and upper insulators 4 comprises a plurality of positioning holes 41 at equal intervals for retaining the second row and the fourth row of contacts 3 in position to define lower and upper contact modules, respectively. Each of the lower and upper insulators 4 further comprises a positioning recess 42 disposed between each pair of adjacent positioning holes 41 for receiving a first row and a third row of contacts 3, respectively. Thus, the first row and the second row of contacts 3 and the third row and the fourth row of contact 3 are respectively assembled in a set in a high density arrangement by the insulator 4 as shown in FIG. 5. Since the contacts 3' of the lower connector are relatively short as compared to the contacts 3 of the upper connector, the contacts 3' are directly received in the corresponding holes 211' of the housing 2' without retention in the insulator 4.

Referring back to FIG. 1, the spacer 5 is retained in a bottom portion of the receiving space 12 of the bracket 1 and abuts against the circuit board. A pair of latch hooks 52 is formed on opposite sides of the spacer 5 for engaging with corresponding grooves (not shown) disposed in inner surfaces of the side walls 13 of the bracket 1 thereby attaching the spacer 5 to the bracket 1. A plurality of through holes 51 is disposed in the spacer 5 and arranged in rows corresponding to rows of the tail portions 32, 32' of the contacts 3, 3'. The tail portions 32, 32' of the contacts 3, 3' extend through the corresponding through holes 51 and are retained by the spacer 5 thereby facilitating subsequent insertion into the corresponding apertures of the circuit board.

Figure 2:
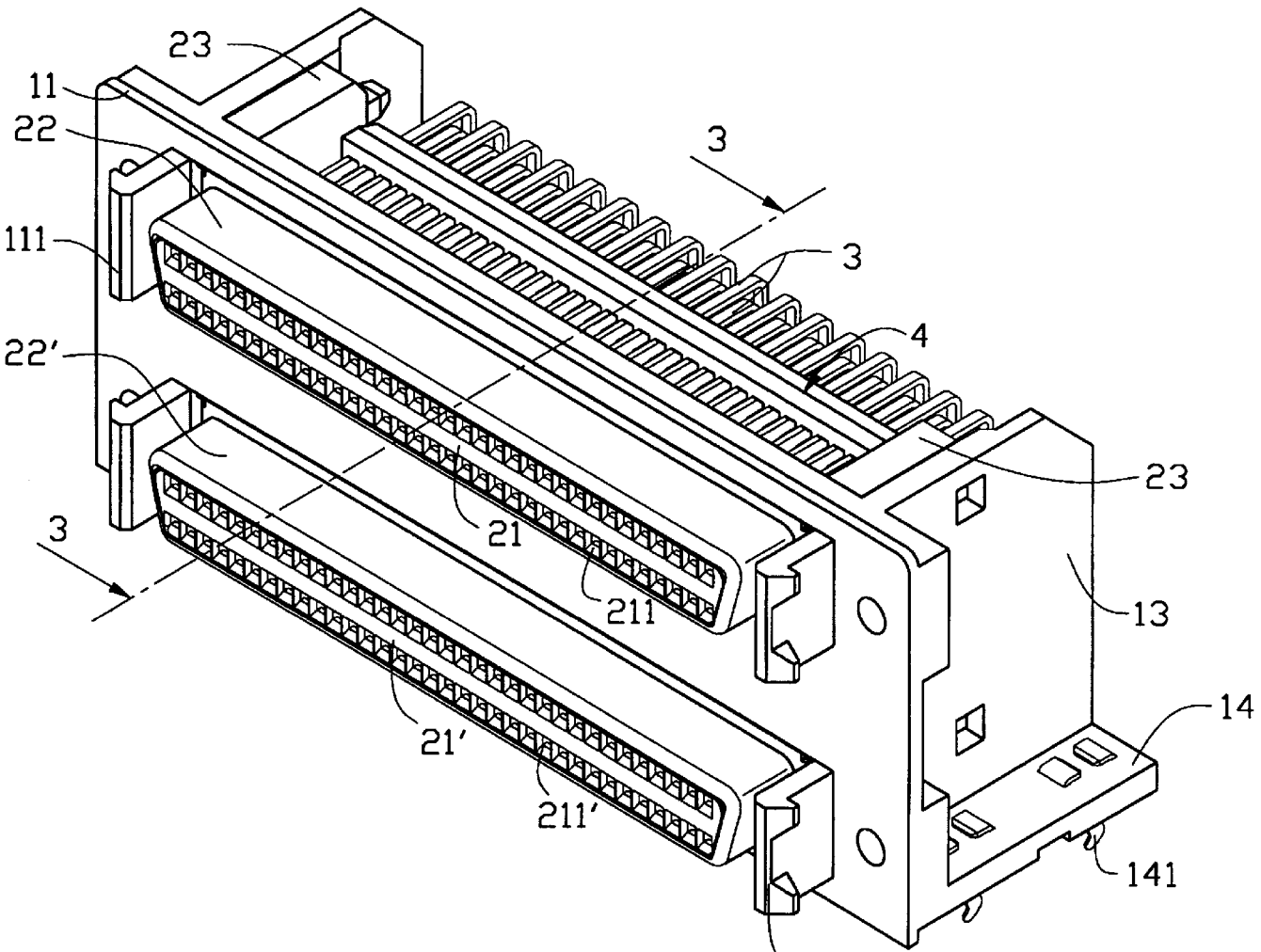
FIG. 2 is an assembled view of FIG. 1.
Figure 3:
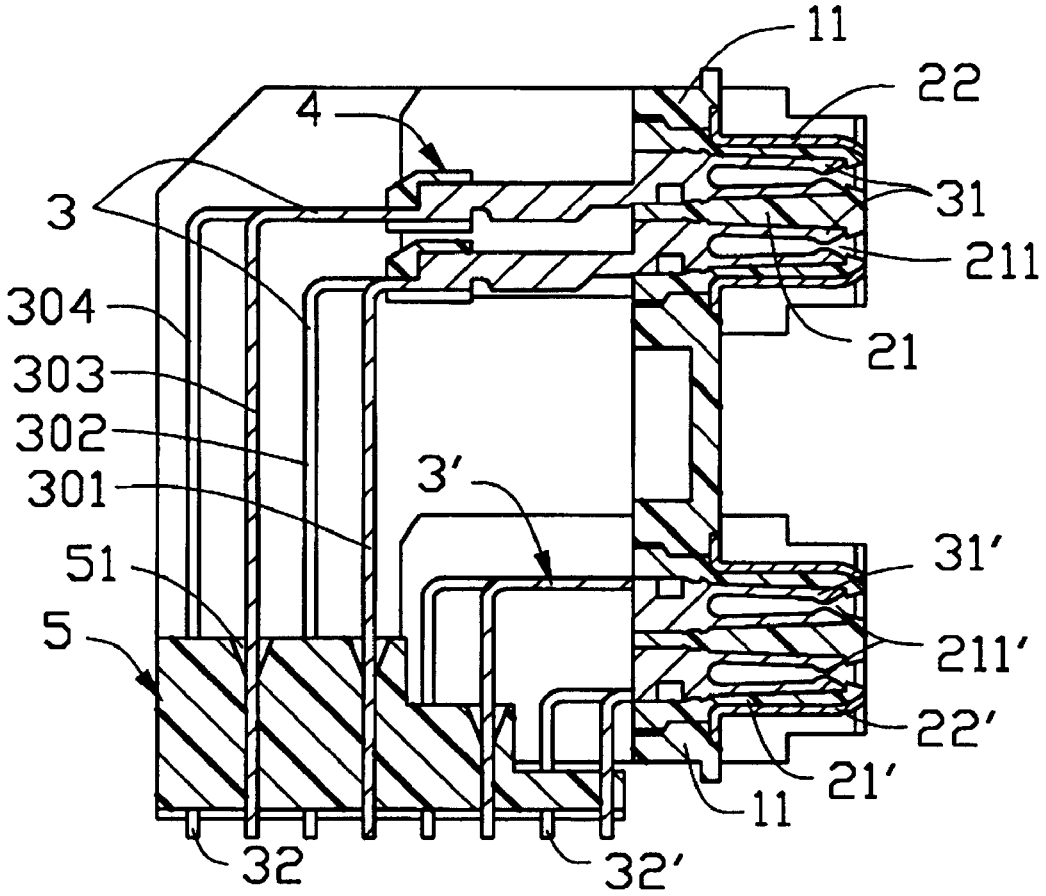
FIG. 3 is a cross-sectional view of the assembled stacked connector assembly taken along line 3—3 of FIG. 2.

Referring to FIGS. 2 and 3, the housing 2 of the upper connector is attached to the bracket 1 by engagement between the engaging means of the arms 23 and the corresponding engaging means on the inner surfaces of the side walls 13 of the bracket 1, as described above. The protrusion 21 of the housing 2 enclosed by the shield 22 projects through the slot 112 of the mating board 11 with the contact portions 31 of the contacts 3 being received therein for mating with corresponding contacts of the mating connector. The contacts 3 together with the integrally molded insulator 4 and the spacer 5 are received in the receiving space 12 defined by the bracket 1. The tail portions 32 of the contacts 3 extend downward through the corresponding through holes 51 of the spacer 5 for insertion into the corresponding receiving holes of the circuit board. The lower connector is attached to the bracket 1 in the same manner as the upper connector, thus a detailed description thereof is omitted herein. The boardlocks 141 are interferentially engaged within the corresponding holes of the base boards 14 for engaging with the circuit board thereby mounting the stacked electrical connector assembly thereon.

A method of retaining the four rows of contacts 3 of the upper connector in position is also provided in accordance with the above-mentioned exemplary embodiment.

Referring to FIGS. 1, 4, 5 and 7, the first row of contacts 3 is first inserted into one subset of the lower row of passageways 211 of the housing 2. The lower insulator 4 is then insert molded around the second row of contacts 3 adjacent to the right-angled bent portions 33 thereof to obtain a lower contact module. The positioning holes 41 are disposed therein for retaining the second row of contacts 3 in position. The positioning recess 42 is formed between each pair of adjacent positioning holes 41. The lower contact module is then inserted into the other subset of the lower row of passageways 211 of the housing 2 with the first row of contacts 3 being received in the corresponding recesses 42 of the lower insulator 4.

Similarly, the third row of contacts 3 is inserted into one subset of the upper row of passageways 211 of the housing 2. The upper insulator 4 is then insert molded around the fourth row of contacts 3 adjacent to the right-angled bent portions 33 thereof to obtain an upper contact module. The positioning holes 41 are disposed therein for retaining the fourth row of contacts 3 in position. The positioning recess 42 is formed between each pair of adjacent positioning holes 41. The upper contact module is then inserted into the other subset of the upper row of passageways 211 of the housing 2 with the third row of contacts 3 being received in the corresponding recesses 42 of the upper insulator 4.

Since the right-angled bent portions 33 of the third row of contacts 3 are located closer to the contact portions 31 thereof than those of the fourth row of contacts 3, the contact portions 31 of the two rows of the contacts 3 are aligned in a row and tail portions 32 thereof are arranged in two rows, which is the same case with the first and second rows of contacts 3. Thus, every two rows of contacts 3 are assembled in a set with the tail portions 32 thereof staggered in two rows having a high density. The contacts 3 are retained by the insulator 4 to prevent an upward movement of the right-angled bent portions 33 of the contact 3 away from the circuit board during insertion of the tail portions 32 thereof into corresponding receiving holes of the circuit board. Due to the provision of the insulators 4, deformation and deflection of the contacts 3 and a short circuit between adjacent contacts 3 are also prevented.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A stacked electrical connector assembly for interconnecting a mating electrical connector with a circuit board, comprising:

a bracket defining a receiving slot;

a connector housing received in the receiving slot, the connector housing defining a row of passageways therethrough;

a first row of contacts received in one subset of the passageways of the connector housing, each of the first row of contacts having a strain portion and a tail portion; and a contact module received in the other subset of the passageways of the connector housing, the contact module consisting of a second row of contacts and an insulator, each of the second row of contacts having a strain portion and a tail portion, the insulator being insert molded adjacent to the strain portions of the second row of contacts for preventing an upward movement of the strain portions of the first row and the second row of contacts away from the circuit board during insertion of the tail portions of the first row and the second row of contacts into corresponding receiving holes of the circuit board;

wherein the insulator is formed as a strip and comprises a plurality of staggered positioning holes and positioning recesses;

wherein the second row of contacts are received in the positioning holes of the insulator, and the first row of contacts abut against inner surfaces of the positioning recesses of the insulator;

wherein the staggered positioning holes and positioning recesses of the insulator are arranged in one row.

2. The stacked electrical connector assembly as described in claim 1, wherein the strain portion of each contact is a right-angled bent portion.

3. The stacked electrical connector assembly as described in claim 1, wherein the connector housing comprises engaging devices formed on opposite sides thereof for engaging with corresponding engaging means of the bracket.

4. The stacked electrical connector assembly as described in claim 3, wherein the bracket comprises a pair of opposite side walls, the engaging means being formed on inner surfaces of the side walls.

5. A stacked electrical connector assembly for interconnecting a mating electrical connector with a circuit board, comprising:

a bracket including a mating board and a mounting surface, the mating board having upper and lower receiving slots defined therein and a mating surface on one side thereof;

an upper and a lower connector housing respectively received in the upper and lower receiving slots, the upper connector housing being distant from the circuit board and the lower connector housing being adjacent to the circuit board, the upper connector housing defining a first row of passageways and a second row of passageways therethrough;

a first row of contacts received in one subset of the first row of passageways of the upper connector housing, each of the first row of contacts having a strain portion and a tail portion;

a lower contact module received in the other subset of the first row of passageways of the upper connector housing, the lower contact module consisting of a second row of contacts and a lower insulator, each of the second row of contacts having a strain portion and a tail portion, the lower insulator being insert molded adjacent to the strain portions of the second row of contacts for preventing an upward movement of the strain portions of the first row and the second row of contacts away from the circuit board during insertion of the tail portions of the first row and the second row of contacts into corresponding receiving holes of the circuit board;

a third row of contacts received in one subset of the second row of passageways of the upper connector housing, each of the third row of contacts having a strain portion and a tail portion; and an upper contact module received in the other subset of the second row of passageways of the upper connector housing, the upper contact module consisting of a fourth row of contacts and an upper insulator, each of the fourth row of contacts having a strain portion and a tail portion, the upper insulator being insert molded adjacent to the strain portions of the fourth row of contacts for preventing an upward movement of the strain portions of the third row and the fourth row of contacts away from the circuit board during insertion of the tail portions of the third row and the fourth row of contacts into corresponding receiving holes of the circuit board.

6. An electrical connector for interconnecting a mating connector with a circuit board, comprising:

an insulative housing having a plurality of contact-receiving passageways arranged in rows;

a plurality of contacts received in a first row and a second row of the contact-receiving passageways, each contact comprising a contact portion at one end thereof, a tail portion at an opposite end thereof extending downward from the housing for connecting to the circuit board, and an intermediate strain portion; and an insulator comprising a plurality of staggered positioning recesses and positioning holes respectively retaining the right-angled bent portions of the first row and the second row of contacts in position, thereby preventing an upward movement of the strain portions of the first row and the second row of contacts away from the circuit board during insertion of the tail portions of the first row and the second row of contacts into corresponding receiving holes of the circuit board;

wherein the insulator is insert molded adjacent to the strain portions of one of the first row and the second row of contacts with the contacts thereof received in the positioning holes of the insulator;

wherein the plurality of staggered positioning recesses and positioning holes of the insulator are arranged in one row.

7. The electrical connector as described in claim 6, wherein the strain portion of each contact is a right-angled bent portion.

8. A method for retaining two rows of contacts in an upper connector of a stacked electrical connector assembly, the upper connector defining a row of passageways therein, the method comprising the steps of:

inserting a first row of contacts into one subset of the passageways of the upper connector;

insert molding an insulator adjacent to strain portions of a second row of contacts of the upper connector to obtain a contact module, the insulator forming a respective positioning recess thereon between each pair of adjacent contacts of the second row; and inserting the contact module into the other subset of the passageways of the upper connector with the first row of contacts being received in the positioning recesses of the insulator.

9. The electrical connector as described in claim 8, wherein the strain portion of each contact is a right-angled bent portion.

10. An electrical connector comprising:

an insulative housing;

a plurality of passageways defined in the housing; and a number of contacts received within the corresponding passageways, respectively, each of said contacts defining a strain portion and a tail portion; wherein some of said contact are embedded in an insulator extending along a lengthwise direction of the housing and positioned on a rear portion of the housing, while the remaining contacts thereof are restrained within corresponding positioning recesses in the insulator around the strain portions thereof for preventing individually upward movement of the tail portions of the contacts, respectively.

* * * * *